US006726038B2

(12) United States Patent
Ko

(10) Patent No.: US 6,726,038 B2
(45) Date of Patent: Apr. 27, 2004

(54) SHELF WITH VARIOUS STORAGE DEVICES FOR A RACK

(76) Inventor: Wen-Shan Ko, No. 23, Shih-Fen, Lin 2, Shih-Fen Village, Chi-Ku Hsiang, Tainan Hsien (TW)

( * ) Notice: Subject to any disclaimer, the term of this patent is extended or adjusted under 35 U.S.C. 154(b) by 0 days.

(21) Appl. No.: 10/231,996

(22) Filed: Aug. 30, 2002

(65) Prior Publication Data

US 2004/0040922 A1 Mar. 4, 2004

(51) Int. Cl.[7] ..... A47F 5/00
(52) U.S. Cl. ..... 211/153; 211/119.003
(58) Field of Search ..... 211/153, 113, 211/117, 85.29, 119.003, 90.04, 90.01

(56) References Cited

U.S. PATENT DOCUMENTS 4,290,531 A * 9/1981 Lazarus, III ..... 211/85.29
D286,964 S * 12/1986 Gecchelin ..... D6/569
5,711,435 A * 1/1998 Morison et al. ..... 211/90.01
D416,151 S * 11/1999 Grosfillex ..... D6/511
D429,582 S * 8/2000 Grosfillex ..... D6/479
D431,407 S * 10/2000 Sorensen et al. ..... D6/574
6,257,425 B1 * 7/2001 Liu ..... 211/90.01
D472,084 S * 3/2003 Kollner ..... D6/513
6,581,788 B1 * 6/2003 Winig et al. ..... 211/90.01
D476,825 S * 7/2003 Adams ..... D6/436

* cited by examiner

*Primary Examiner*—Daniel P. Stodola
*Assistant Examiner*—Erica B. Harris
(74) *Attorney, Agent, or Firm*—Jackson Walker LLP

(57) ABSTRACT

A shelf for a rack is adapted to be secured between two vertical supports and is composed of a plate (22) having multiple securing holes (221) and various storage devices detachably mounted on the plate (22). The storage devices have multiple feet to mount in the securing holes (211) and fasten to the plate to compact space between adjacent shelves.

5 Claims, 8 Drawing Sheets

SHELF WITH VARIOUS STORAGE DEVICES FOR A RACK

BACKGROUND OF THE INVENTION

1. Field of the Invention

The present invention relates to a shelf for a rack, and more particularly to a shelf with various storage devices to conveniently hold a variety of objects in an orderly manner.

2. Description of Related Art

How and where to store articles of daily use in an orderly manner is always an important consideration, especially for people who live in small houses or apartments. A rack having multiple shelves is always a help to people for storing articles of daily use to efficiently use available living space. Conventional racks usually have multiple shelves or boxes vertically stacked together had multiple rods extending between adjacent shelves or boxes to support the whole rack. The rods are usually the same size to limit production cost so the distance between adjacent shelves or boxes is the same. However, different types of objects cannot be efficiently stored on such racks. For example, a lot of space is wasted if the objects are much shorter than the distance between adjacent shelves. Additionally, the shelves or boxes of conventional racks cannot securely hold fragile objects such as dishes, bowls, wine glasses, etc. which are not suitable for storage on the racks. Therefore, the use of the conventional rack is limited to non-fragile objects such as cans, other groceries, linens, clothes, etc.

Therefore, the present invention has arisen to mitigate and/or obviate the drawbacks of the conventional rack.

SUMMARY OF THE INVENTION

The main objective of the present invention is to provide a shelf for a rack on which multiple storage devices can be securely attached to efficiently use space between adjacent shelves and to enhance the use of the rack.

Further benefits and advantages of the present invention will become apparent after a careful reading of the detailed description with appropriate reference to the accompanying drawings.

DETAILED DESCRIPTION OF THE INVENTION

Figure 1:
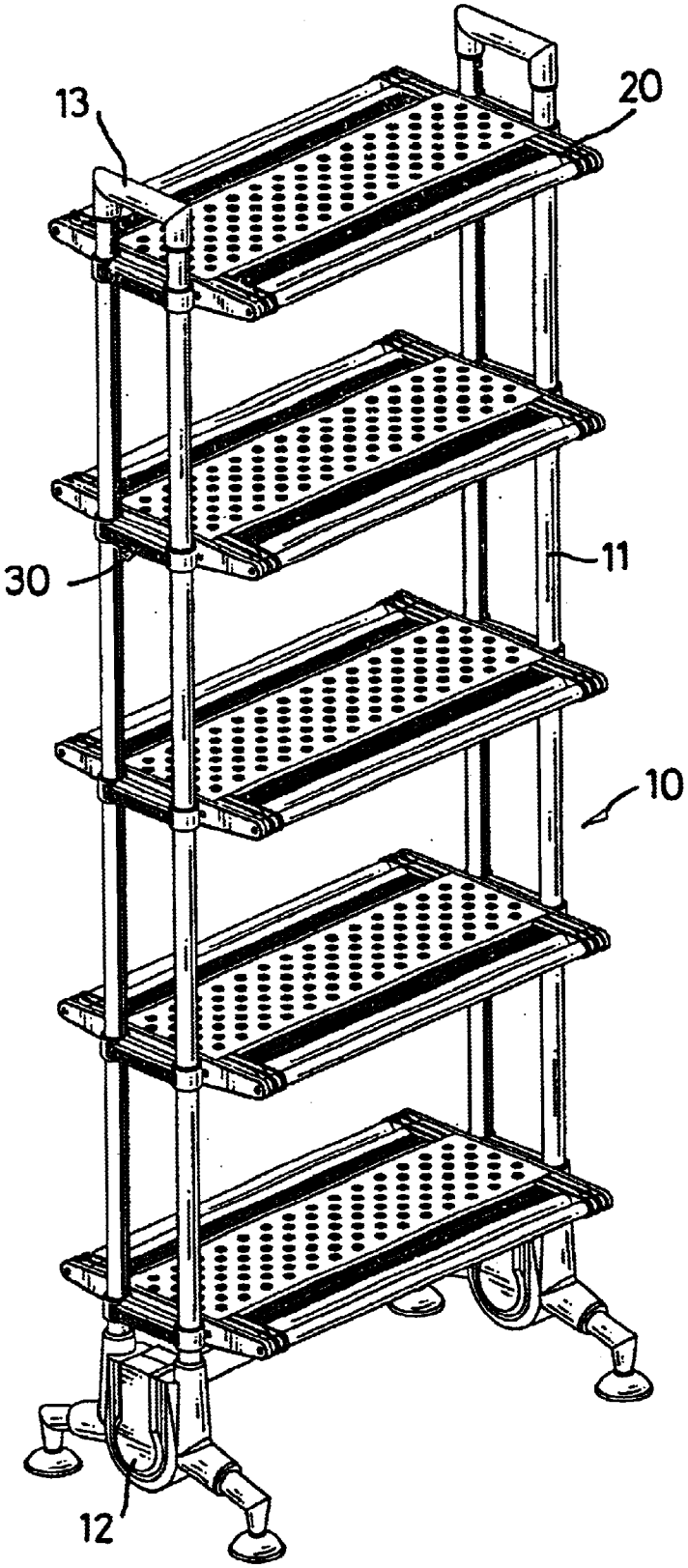
FIG. 1 is a perspective view of multiple shelves in accordance with the present invention mounted on a rack.

With reference to FIG. 1, at least one shelf (20) in accordance with the present invention is adapted to be mounted between two vertical supports (10) of a rack. Each vertical support (10) is composed of a foot (12), a top frame (13) and two support rods (11) erected vertically between the foot (12) and the top frame (13).

Figure 2:
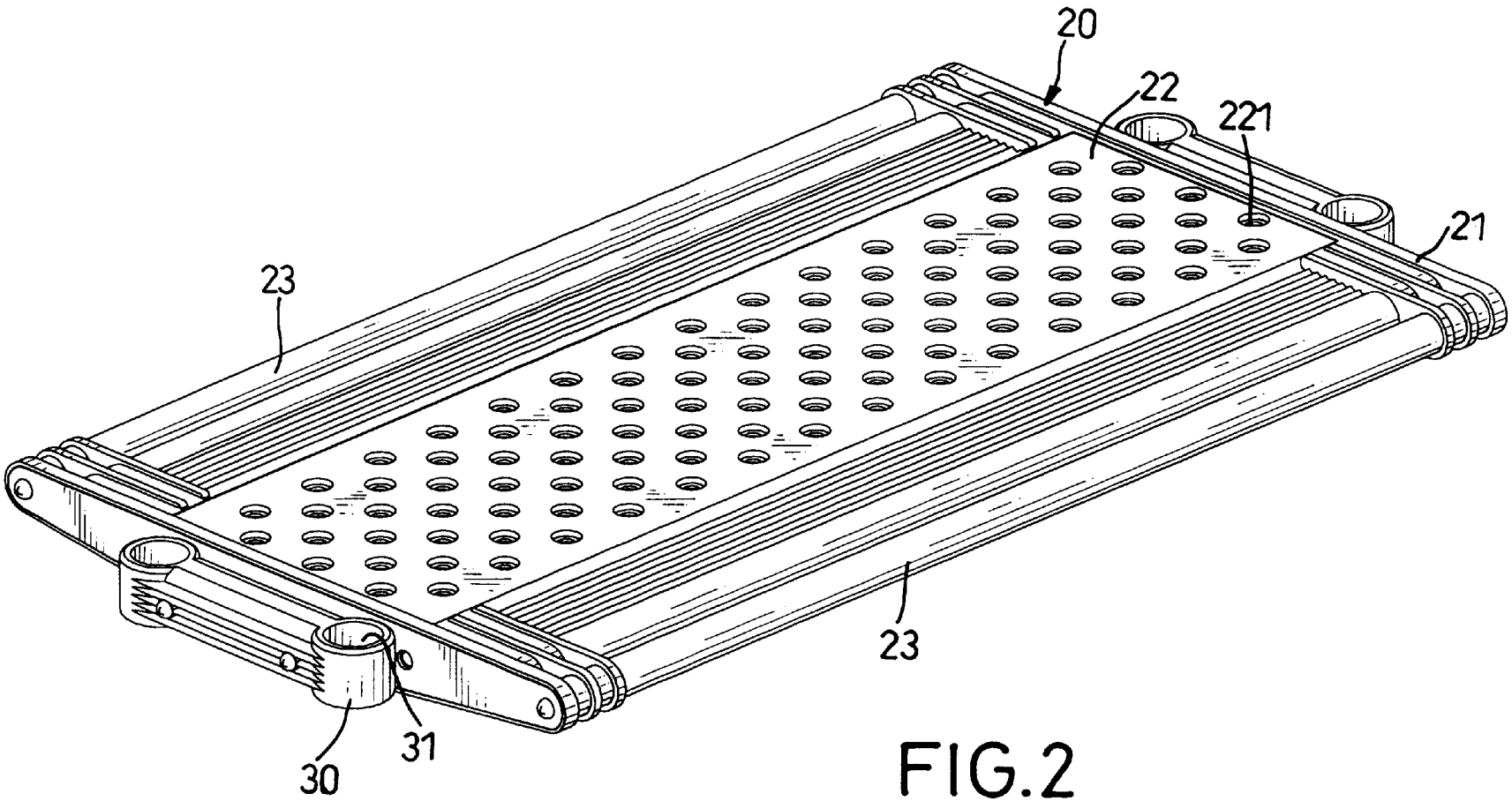
FIG. 2 is an enlarged perspective view of a shelf in FIG. 1.
Figure 3:
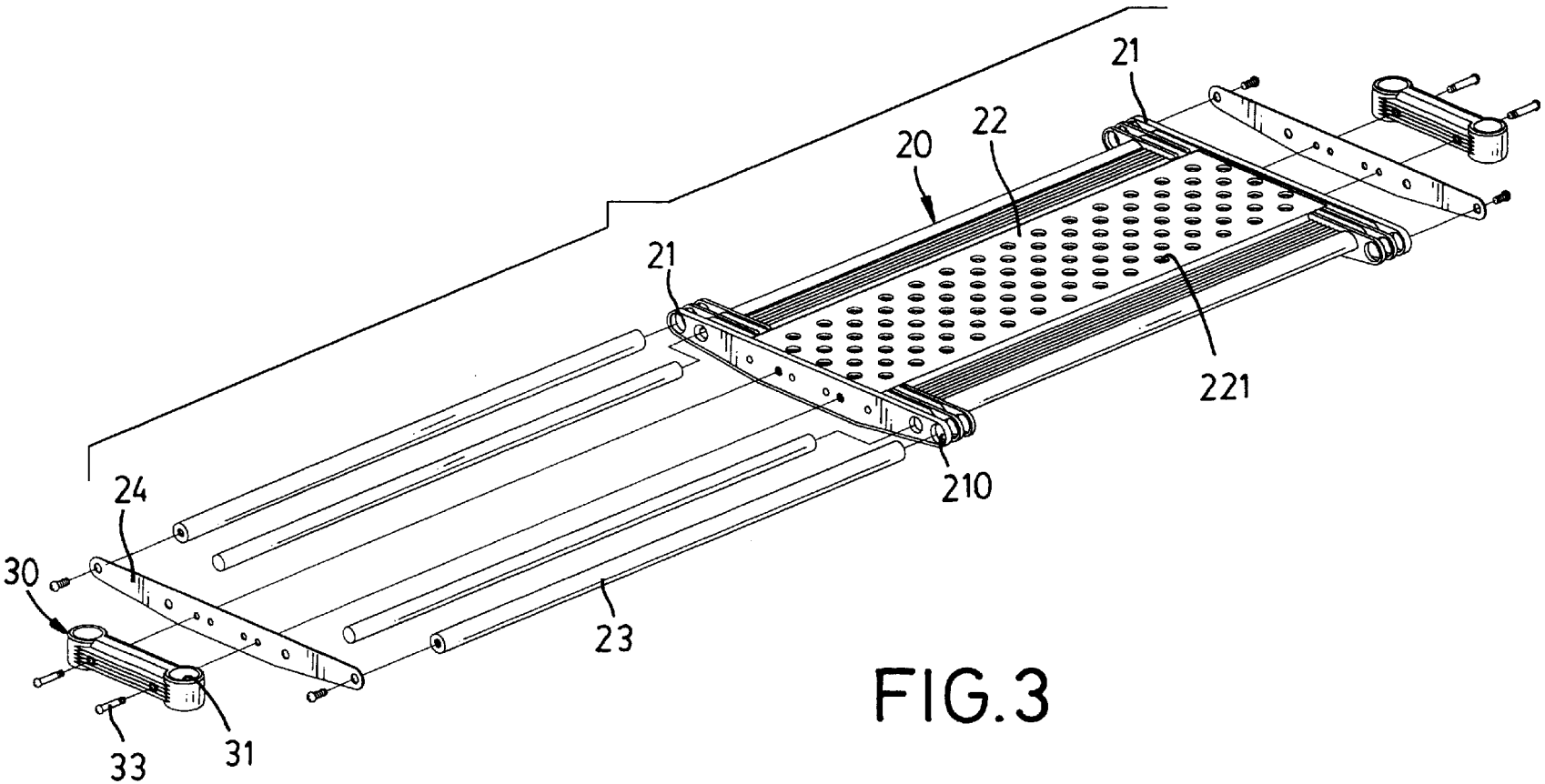
FIG. 3 is an exploded perspective view of the shelf in FIG. 2.

With reference to FIGS. 2 and 3, each shelf (20) comprises a flat plate (22), two mounting-bars (30), multiple securing holes (221), two enlarged end brackets (21), at least two extending rods (23) and at least one storage device (not shown). The flat plate (22) has a front edge, a rear edge and two ends. The mounting-bars (30) are respectively mounted on opposite ends of the flat plate (22). The securing holes (221) are defined vertically through the plate (22). The enlarged end brackets (21) are mounted on opposite ends of the plate (22), and each enlarged end bracket (21) has two ends (not numbered), is composed of multiple plates and extends out from the front and rear edges of the plate (22). At least one rod-hole (210) is defined in each end of the enlarged end bracket (21), and an extending rod (23) passes through the rod-hole (210) to be attached to the front and rear edge of the plate (22). A attaching flange (24) corresponds and is secured to each enlarged end bracket (21) by means of screws. Additionally, each securing hole (221) defined in the plate is a countersunk hole with a through diameter and a larger diameter at the surface of the plate (22).

Each mounting-bar (30) has two ends and is attached to the corresponding attaching flange (24) by means of screws (33). A hole (31) is defined in each end of each mounting-bar (30) to correspond to the support rod (11) of the vertical support (10). Additionally, four securing members (now shown) respectively corresponding to the holes (31) in the mounting-bars (30) are mounted in the support rods (11) to selectively mount the shelf (20) at a desired position in the rack (10).

Figure 4:
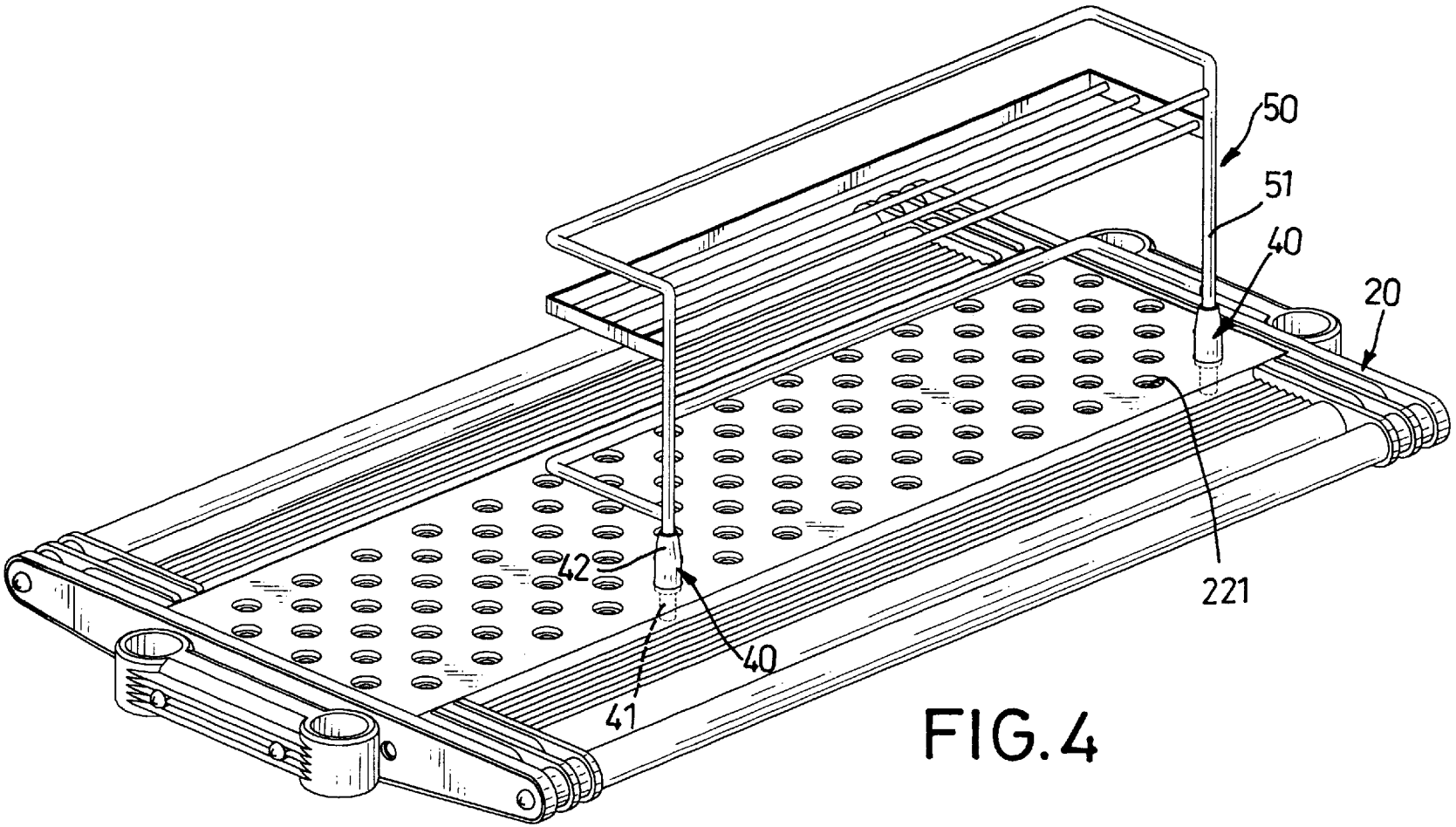
FIG. 4 is a perspective view of the shelf in FIG. 2 with a first embodiment of a storage device in accordance with the present invention.

With reference to FIG. 4, a first embodiment of the storage device is a standing rack (50) having multiple layers and feet (51). The standing rack (50) attaches to the shelf (20) by inserting the feet (51) into corresponding securing holes (221) on the plate (22). An attachment fitting (40) is mounted on each foot (51) of the standing rack (50) and has a first section (41) and a second section (42) with different diameters. The diameter of the first section (41) corresponds to the through diameter of the hole (221), and the diameter of the second section (42) corresponds to the diameter of the hole (221) at the surface of the plate (22). The corresponding diameters make the standing rack (50) stable on the shelf (20).

Figure 5:
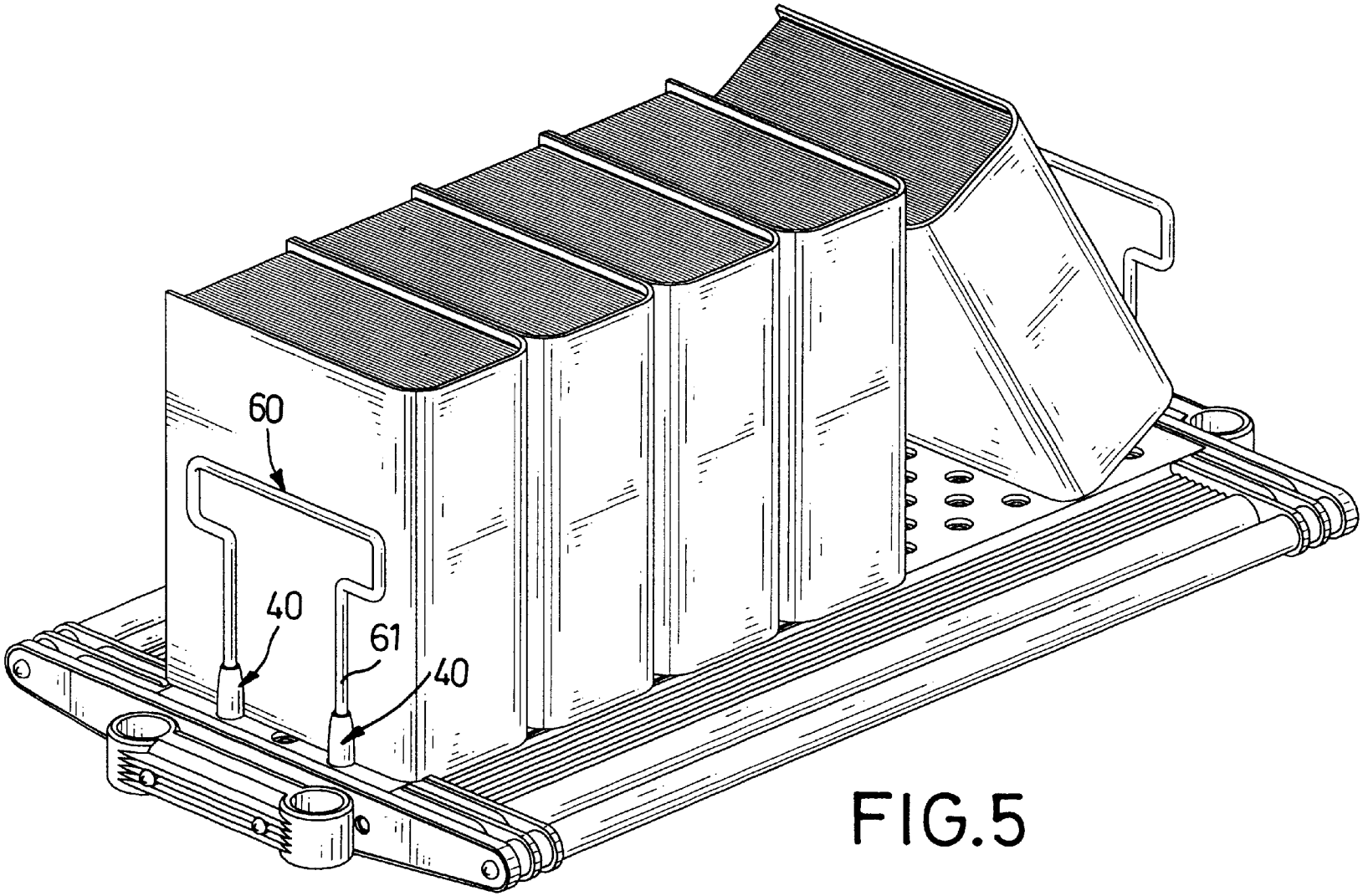
FIG. 5 is a perspective view of the shelf in FIG. 2 with a second embodiment of the storage device in accordance with the present invention.

With reference to FIG. 5, a second embodiment of the storage device is a bookend (60). The bookend (60) has multiple feet (61) and is attached to the shelf (20) by inserting the feet (61) into corresponding securing holes (221) on the plate (22). An attachment fitting (40) as previously described is mounted on each foot (61) of the bookend (60) to correspond to the countersunk hole to make the bookend (60) stable on the shelf (20).

Figure 6:
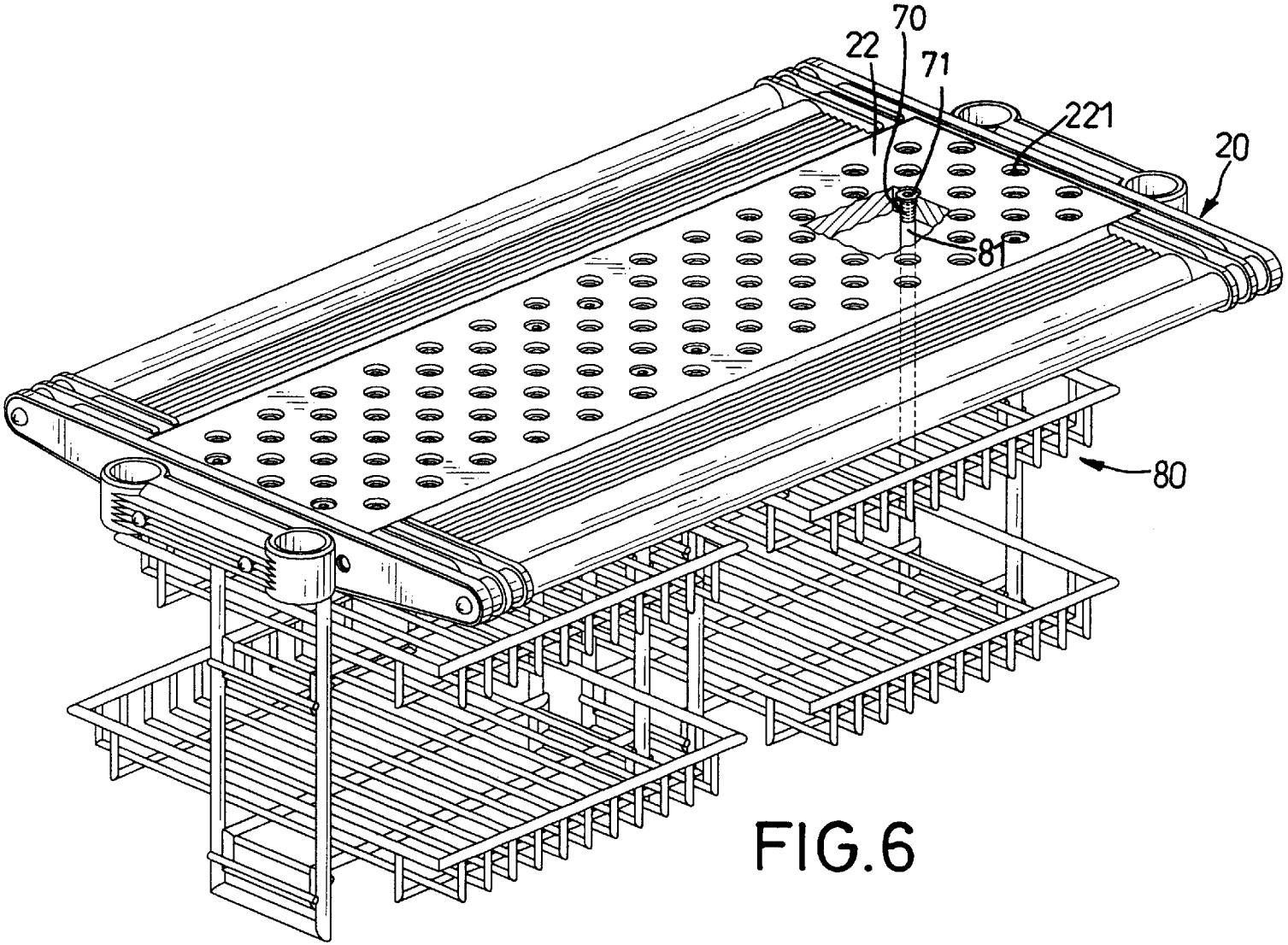
FIG. 6 is a perspective view of the shelf in FIG. 2 with a third embodiment of the storage device in accordance with the present invention.

With reference to FIG. 6, a third embodiment of the storage device is a hanging rack (80) having multiple layers and upright posts (81). The hanging rack (80) attaches to the shelf (20) by inserting the posts (81) into corresponding securing holes (221) on the plate (22). When the posts (81) of the hanging rack (80) are positioned in corresponding countersunk holes (221), a screw (70) with a head (71) is placed through the corresponding countersunk hole (221) and screwed into a threaded hole (not numbered) defined in the post (81).

Figure 7:
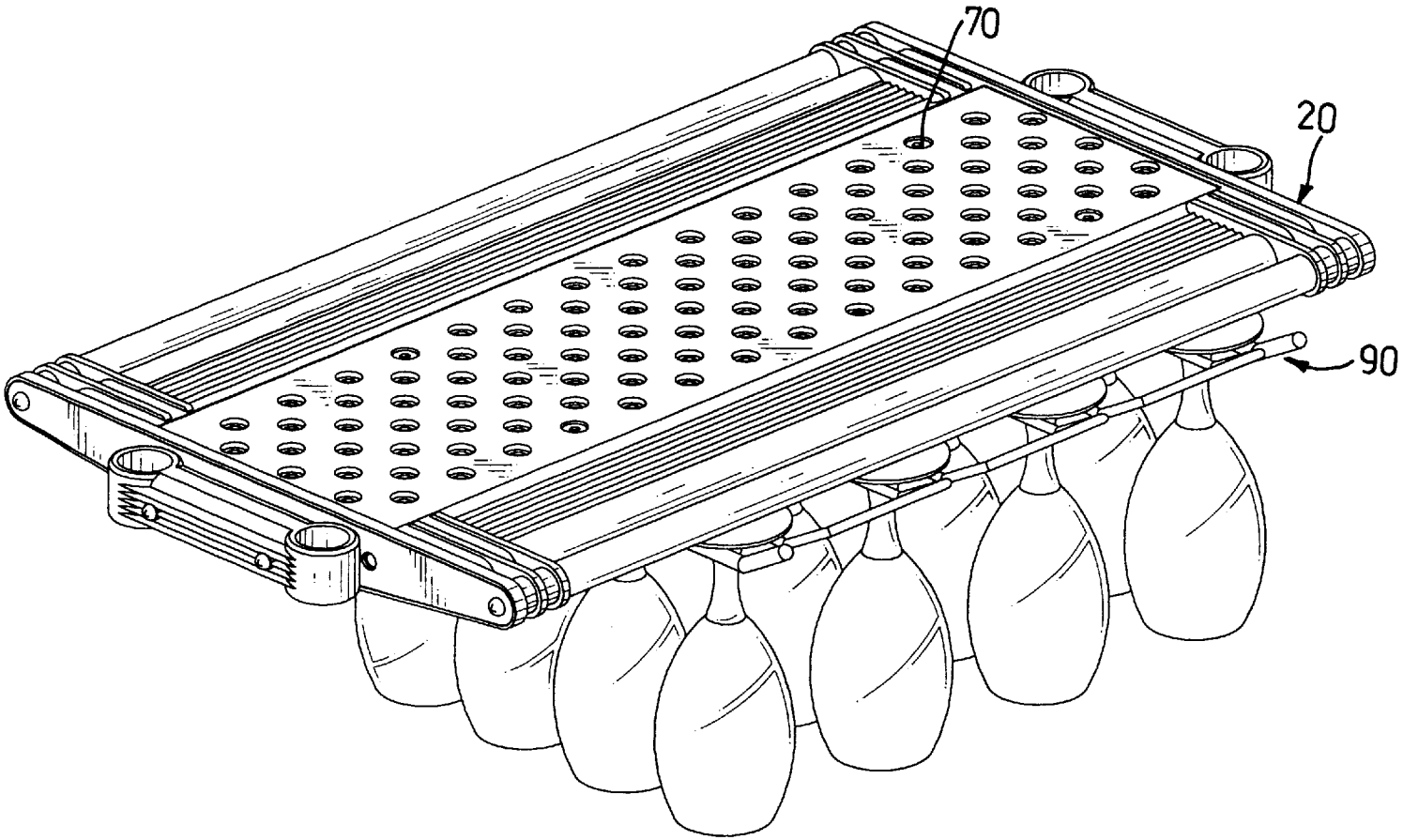
FIG. 7 is a perspective view of the shelf in FIG. 2 with a fourth embodiment of the storage device in accordance with the present invention.

With reference to FIG. 7, a fourth embodiment of the storage device is a hanging wineglass rack (90). The hanging wineglass rack (90) has multiple upright posts (not shown) and is attached to the shelf (20) by inserting the posts into corresponding securing holes (221) in the plate (22). When the posts of the hanging wineglass track (90) are positioned in the countersunk holes (221), a screw (70) with a head is placed through the corresponding countersunk hole (221) and is screwed into a threaded hole defined in the post.

Figure 8:
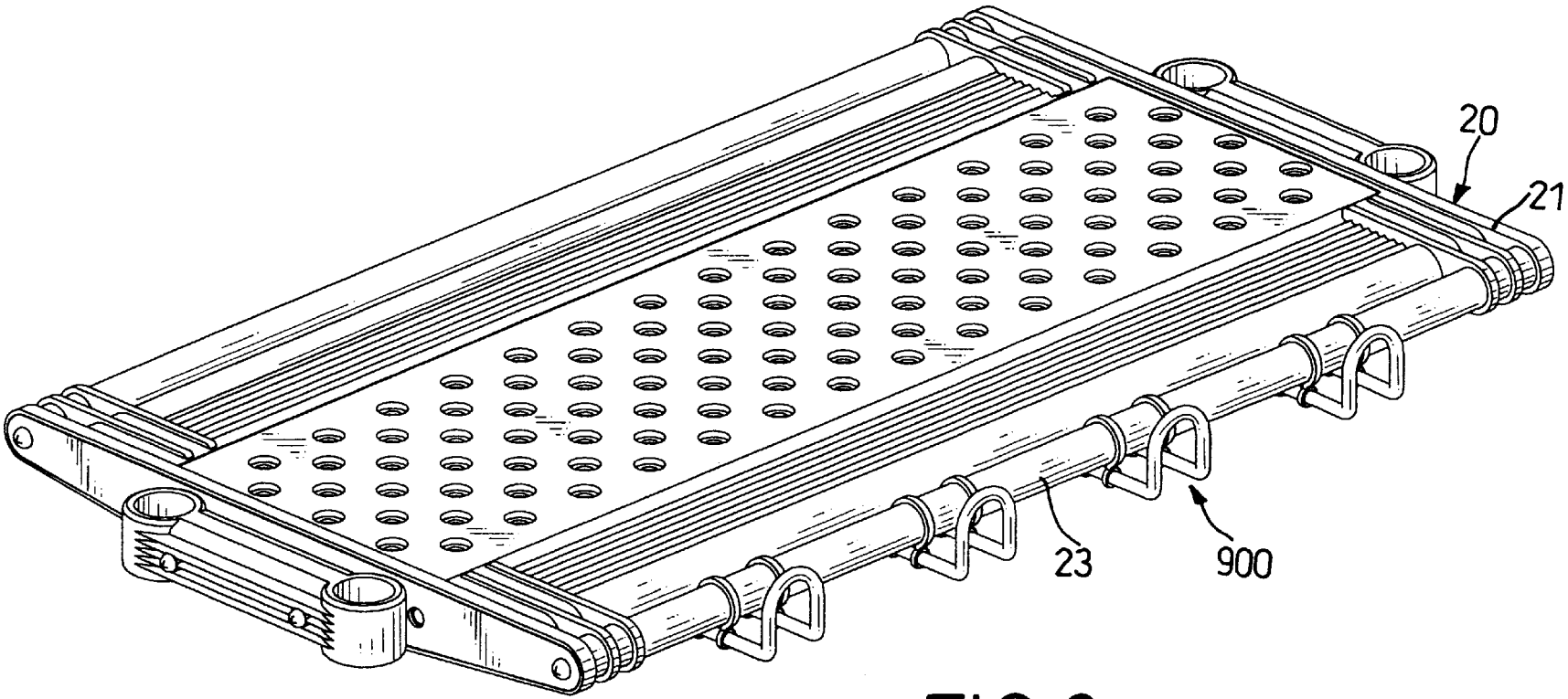
FIG. 8 is a perspective view of the shelf in FIG. 2 with a fifth embodiment of the storage device in accordance with the present invention.

With reference to FIG. 8, a fifth embodiment of the storage device is a cup hook (900) slidably mounted around the extending rods (23) on the plate (22).

Although the invention has been explained in relation to its preferred embodiment, it is to be understood that many other possible modifications and variations can be made without departing from the spirit and scope of the invention as hereinafter claimed.

What is claimed is:

1. A shelf (20) with various storage devices for a rack comprising:

a plate (22) with two opposite ends and having multiple securing holes (221) defined through the plate (22);

two enlarged end brackets (21) respectively formed at the two opposite ends on the plate (22), wherein each enlarged end bracket (21) has two securing ends extending out of the plate (22);

a least one extending rod (23) secured between the securing ends of the enlarged end brackets (21); and an attaching flange (24) secured at each opposite end on the plate (22);

two mounting-bars (30) attached respectively to the attaching flanges (24) at the two opposite ends of the plate (22) and adapted to engage detachably between two support rods (11) of the rack (10); wherein each mounting-bar (30) has two ends and a hole (31) defined in each end of each mounting-bar (30) to correspond to the support rod (11); and at least one storage device engaged with the plate via the securing holes (221).

2. The shelf as claimed in claim 1, in which a securing member is attached to each mounting-bar (30) to attach the plate (22) securely to a corresponding one of the support rods (11) and to selectively fasten the shelf (20) to the rack (10).

3. The shelf as claimed in claim 1, wherein each securing hole (221) defined in the plate is a countersunk hole with a through diameter and a surface diameter; and each storage device has multiple feet and an attachment fitting (40) secured on each foot of the storage device, wherein each attachment fitting (40) has a first section (41) and a second section (42) with different diameters where the diameter of the first section (41) corresponds to through diameter of one of the countersunk holes (221) and the diameter of the second section (42) corresponds to the surface diameter of the corresponding countersunk hole (221) to make the storage device stable on the shelf (20).

4. The shelf as claimed in claim 1, wherein each securing hole (221) is a countersunk hole with a through diameter and a larger surface diameter;

each storage device has multiple upright posts each mounted in one of the countersunk holes and a threaded hole defined in each post; and a screw (70) with a head (71) is placed through one of the countersunk holes and screws into the threaded hole in one of the corresponding post to attach the storage device on the shelf (20).

5. The shelf as claimed in claim 1, wherein each of the at least one extending rods (23) has multiple cup hooks (900) mounted around the extending rods (23).

* * * * *